United States Patent [19]

Brungraber

[11] 4,305,706

[45] Dec. 15, 1981

[54] UNITARY PROTECTIVE REFRACTORY MEMBER

[75] Inventor: Louis E. Brungraber, Mt. Lebanon, Pa.

[73] Assignee: Bloom Engineering Company, Inc., Pittsburgh, Pa.

[21] Appl. No.: 172,208

[22] Filed: Jul. 25, 1980

[51] Int. Cl.[3] ..... F27D 3/02

[52] U.S. Cl. ..... 432/234; 138/147

[58] Field of Search ..... 432/234; 138/147

[56] References Cited

U.S. PATENT DOCUMENTS

| | | | |
|---|---|---|---|
| 3,804,585 | 4/1974 | Twort | 432/234 |
| 4,182,609 | 1/1980 | Hovis et al. | 432/234 |
| 4,255,127 | 3/1981 | Skifano et al. | 432/234 X |

*Primary Examiner*—John J. Camby

*Attorney, Agent, or Firm*—Webb, Burden, Robinson & Webb

[57] ABSTRACT

An elongated unitary refractory member having a horseshoe-shaped configuration is defined by opposing legs, each having a distal section, an interior surface adjacent to and extending between the distal sections, an outer surface and slot-like openings extending radially through the distal sections adjacent the interior surface. An interconnected reticulated metal structure is solidly embedded within the member and positioned adjacent the interior surface. A connecting plate is secured to the metal structure at each distal section and includes tabs in registry with the slots to permit access to the tabs for attachment to a water-cooled pipe or the like which is to be protected in a high temperature heat treating furnace.

4 Claims, 4 Drawing Figures

UNITARY PROTECTIVE REFRACTORY MEMBER

FIELD OF THE INVENTION

This invention relates to furnace insulation systems and, more particularly, to a unitary protective refractory member for skid pipe, tandem pipe or other heat absorptive elements in which more than 180° but less than 360° of surface is exposed and requires protection.

DESCRIPTION OF THE PRIOR ART

A number of different furnace insulation systems have been utilized in modern-day, high temperature heat treating furnaces to protect the metal structures contained therein. The structures include various forms of water-cooled pipe such as skid pipe and crossover pipe as well as other support members on pusher furnaces as well as moving and fixed horizontal beams on walking beam furnaces. Since the pipe are hollow and water-cooled, they are extremely heat absorptive. These pipe must be protected to minimize the heat losses of the furnace. The insulation systems which provide this protection are subjected to high and cyclic temperatures, repetitive vibrations, scale build-up and occasional damaging blows from workpieces or chunks of metal and scale.

In general, the pipe to be protected includes 360° of exposed surface area about which two semi-cylindrical sections of reinforced refractory insulation have been secured. Sections of insulation are then installed in end to end relationship until the entire pipe is protected. However, in certain applications a lesser portion of the pipe need be protected for a variety of reasons. One such application is skid pipe where a wear bar is secured to the top of the pipe and this wear bar accommodates slabs which are pushed thereover and which are supported by the skid pipe. In other applications pipe are utilized in tandem so that less than 360° of each pipe need be protected. The ends of crossover pipe, primarily on pusher furnaces, and applications in walking beam furnaces often require protection for less than the total surface area of the pipe or structural member. Generally, in all of the aforesaid mentioned applications, more than 180° but less than 360° of pipe surface must be protected in order to provide an adequate insulation system.

Heretofore, previous insulation systems have been employed which include semi-cylindrical sections of reinforced refractory insulation joined together and welded or otherwise attached to the pipe. One such basic system is disclosed in U.S. Pat. No. 2,693,352. This system includes refractory sections having interconnected reticulated metal mesh embedded therein with the mesh being exposed at the junction of the two sections and which is thereafter welded to the pipe.

Another such system is disclosed in U.S. Pat. No. 3,647,194 where semi-cylindrical sections include spaced, plug-like openings through which the reticulated metal structure is welded to the pipe. Another improved protective refractory member is disclosed in U.S. Pat. No. 4,182,609 where two semi-cylindrical parts are connected at their respective longitudinal edges through clips and loops which are connected to the reticulated metal mesh.

Each of the above systems has one thing in common, namely, the utilization of two semi-cylindrical sections joined together. Where applications require less than 360° of surface area to be protected, heretofore the members have merely been made less than semi-cylindrical so that when the two sections are joined about the pipe, the requisite surface area is protected. The connection of the two sections is generally along the bottom of the member being protected and comprises a hinged connection formed of hooks, pins, studs or the like.

A bottom joint or a joint near the bottom has been an ever present problem of significant proportion. It is extremely difficult to adequately apply grouting to such a joint. The grouting tends to fall out since the taper of the joint, by necessity, is in the wrong direction. Attempts to design a reverse tapered bottom joint or move the bottom joint off to the side have also proven unsuccessful. When the grouting fails, the bottom connection is exposed to excessive heat causing the entire insulation system to open up, thereby deleteriously effecting the heat insulation capability. In addition, where pins have been used to connect two sections of refractory, the pin has been subjected to bending, particularly if any grouting is lost. Where other forms of bottom connections are employed, considerable manufacturing problems arise due to the necessity to maintain close tolerances.

Other patents in this area which teach two separate parts secured to each other generally through a bottom connection to protect pipe are U.S. Pat. Nos. 3,486,533, 4,070,151, 4,134,721, 3,914,100 and 3,781,167.

Various attempts to provide a single unitary member to eliminate any bottom joints have not proven successful. Previous attempts have been made to use a horseshoe configuration but such attempts have not proven successful. One such system included connecting wires extending out of the refractory which had to be tied about the pipe. Another system involved a kiln fired shape which was not reinforced and which was positioned on the pipe from above it. The shape was notched and a refractory plate was inserted into the notch to close off the open end of the horseshoe. Where tandem pipe is involved, attempts have been made to totally encapsulate the two pipes through two U-shaped members of different sizes which were joined about the tandem pipe. A single member (made in a two section mold) has been provided with an articulated bottom hinge. However, an exposed bottom area still requires grouting of a bottom notch and, therefore, all of the aforementioned problems remain.

SUMMARY OF THE INVENTION

I have now provided a unitary protective refractory member which completely eliminates the bottom hinge connection and open area utilized heretofore. I, therefore, provide a single unitary member which can be easily installed without any sacrifice in the insulating efficiency of the total insulation system in a high temperature heat treating furnace and the like. All of the problems associated with an open bottom area have thus been completely eliminated.

The unitary member has a horseshoe-shaped configuration defined by opposing legs each having a distal section, an interior surface adjacent to and extending between the distal sections for intimate contact with the pipe, an outer surface and slot-like openings extending radially through the distal sections adjacent the interior surface. An interconnected, reticulated metal mesh is solidly embedded within the member and is positioned adjacent the interior surface. A connecting plate is secured to the metal structure at each distal section and includes tabs in registry with and exposed by the slots to permit access to the tabs for attachment to the pipe.

DESCRIPTION OF THE PREFERRED EMBODIMENTS

Figure 1:
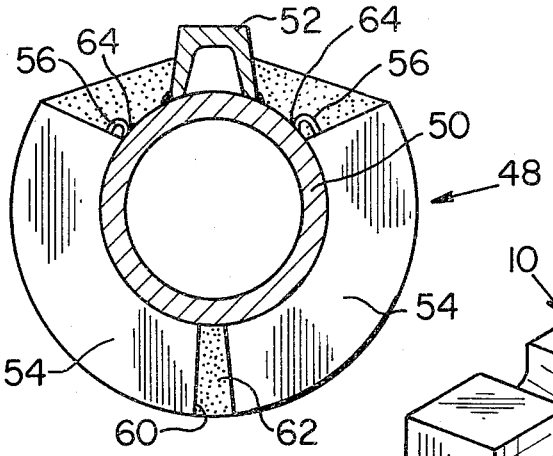
Fig. 1 (PRIOR ART)
FIG. 1 is a section through a prior art protective refractory member.

A prior art protective refractory member for protecting skid pipe and having a hinged bottom connection is illustrated in FIG. 1. The protective refractory member 48 is secured about a water-cooled pipe 50 having a wear bar 52 extending along its upper surface thereof. Member 48 includes two reinforced refractory sections 54 held together by a reticulated metal mesh (not shown) extending within and about refractory member 48. A tapered notch 60 extends between the two sections 54 along the bottommost point of the member 48. The notch 60 permits the two sections 54 to pivot about articulation points of the metal mesh. Loops 56 of the metal mesh are exposed along the ends of the refractory sections 54 and these exposed loops 56 are connected to the pipe 50 by welds 64. Grouting 62 is employed to fill in the tapered notch 60 and also between the refractory sections 54 and the wear bar 52.

Figure 2:
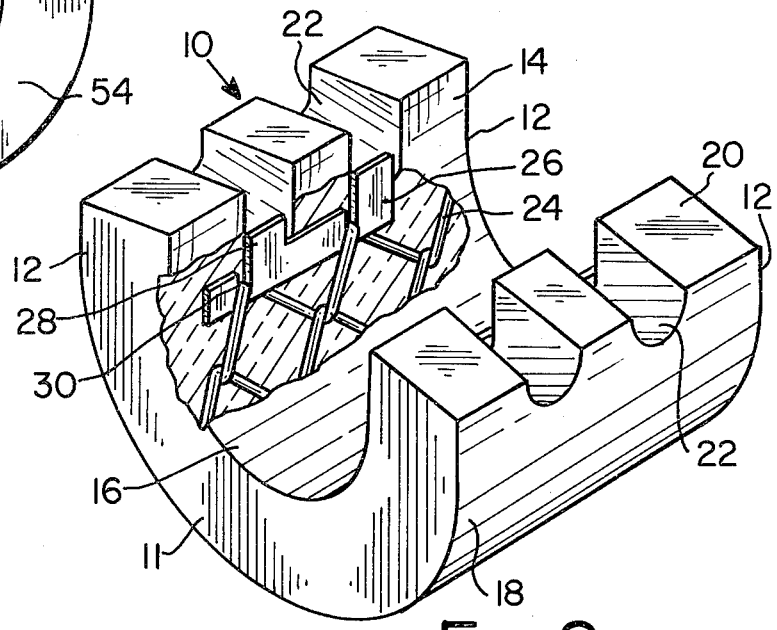
FIG. 2 is a perspective view, partly broken away, of our unitary protective refractory member.

My refractory member, generally designated 10, has generally a U-shaped configuration but because the free ends of the U have sufficient length to pass well beyond the horizontal center line of a pipe to be protected, the configuration is referred to as horseshoe-shaped, FIG. 2. Member 10 includes an arcuate section 11 extending into opposing legs 12. Each opposing leg 12 terminates in a distal section 14 which generally describe that portion of the member extending beyond the horizontal center line or the lower 180° surface area of the pipe being protected. The member 10 includes an interior surface 16 which extends between the distal sections 14 for intimate contact with the lower 180° surface of the pipe, an exterior surface 18 forming the perimeter of the member and top surfaces 20 which terminate the respective distal sections 14.

A reticulated wire mesh 24 is wholly embedded within the member 10 and is positioned just below the interior surface 16. The wire mesh 24 extends throughout the arcuate portion 11 and terminates in the area of the distal sections 14. A connecting plate 26 is secured to the opposing ends of the wire mesh 24. Each connecting plate 26 includes two upwardly extending tabs 28 and two grooves 30 adjacent the tabs, which grooves interengage the ends of the wire mesh 24.

Figure 4:
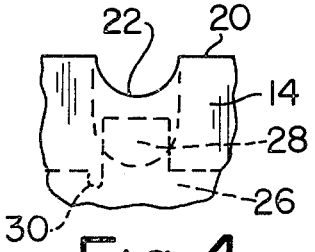
FIG. 4 is a section taken along lines III—III of FIG. 3.

Each distal section 14 includes two slots 22, which slots extend radially through the member 10 and are open from the top surface 20 of the distal sections 14. Slots 22 are tapered with the largest slot depth occurring adjacent the interior surface 16. The tabs 28 of connecting plate 26 are positioned so as to be exposed by the slots 22, FIGS. 1 and 4. Actual radial holes could also be employed although the slots, as illustrated, maximize the open area available for welding as will be described hereinafter. The term slots, as used, is intended to cover any appropriate opening including radial holes.

The member 10 will generally be a pressed refractory or a castable refractory in which the wire mesh and connecting plates are embedded during the manufacturing operation.

Figure 3:
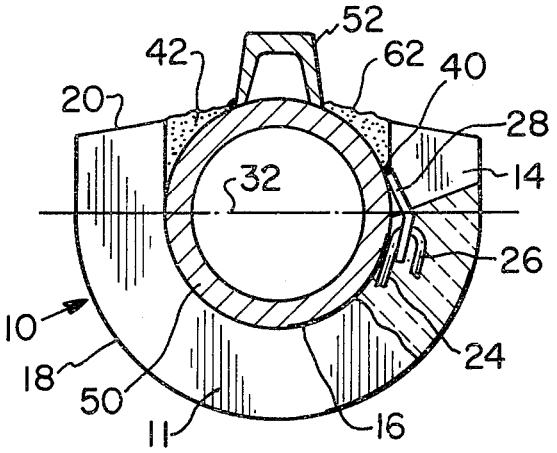
FIG. 3 is a section through a skid pipe in which the refractory member is partly broken away.

Member 10 is installed about a pipe 50 having a wear bar 52 welded along the upper surface thereof as illustrated in FIG. 3. Member 10 is slipped onto the pipe 50 from the bottom side thereof so that the interior surface 16 of the arcuate section 11 is in intimate contact with the pipe 50 up to the horizontal center line 32 of the pipe 50. Since the connecting plate 26 is embedded adjacent to the interior surface 16, the tabs 28 normally are bent such as by tapping into engagement with the pipe 50. A weld 40 is then made along the top of each tab 28 securing the tab and thus the member 10 to the pipe 50. The weld 40 is made by inserting the appropriate welding device through the slots 22. The slots 22 do not actually have to extend all the way to the exterior surface 18 of the member 10 as long as sufficient space is provided to get the welding implement to the tabs 28. The straight distal sections 14 extend above the center line 32 of the curved pipe so as to form a space 42 therebetween. The distal sections 14 extend upward to a point where the upper surface 20 thereof is approximately in line with the bottom of the wear bar 52. The space 42 as well as the slots 22 are then filled in by appropriate grouting 62.

The above embodiment provides a unitary member which can be easily installed to protect more than 180° but less than 360° of pipe surface without the need for the two individual sections, bottom hinges or connections and the like. There is no sacrifice of insulating characteristics and the installation is substantially simpler in view of the elimination of a major connection between parts and/or the need to apply grouting to a tapered notch at the absolute bottom of the member where the grouting tends to fall out, thus making the application of the grouting more difficult to apply and retain.

I claim:

1. An elongated one-piece protective refractory member for protecting heat absorptive elongated elements in a high temperature heat treating furnace wherein more than 180° and less than 360° of surface of said elements is exposed and requires protection comprising:

A. an elongated one-piece refractory member having a horseshoe-shaped configuration and no bottom joint defined by opposing legs, each having a distal section, an interior surface subjacent to and extending between the distal sections for intimate contact with said elements, an outer perimetric surface and slot-like openings extending radially through the distal sections adjacent the interior surface;

B. an interconnected reticulated metal structure soidly embedded within said member, extending throughout said member to said legs and positioned adjacent the interior surface; and C. a connecting plate secured to the metal structure at each distal section and having tabs in registry with and exposed by said slots to permit access to the tabs for attachment to the elongated elements.

2. The member of claim 1 wherein each slot extends through the exterior surface and is tapered so as to be of greatest depth adjacent the interior surface at the tabs.

3. The member of claim 2 wherein two slots are provided in spaced relationship in each distal section and each of said connecting plates includes two tabs.

4. In a high temperature heat treating furnace, the combination of an elongated refractory member positioned about and protecting a water-cooled pipe having a wear bar along an upper surface thereof, said member comprising:

A. an elongated one-piece pressed or cast refractory having a horseshoe-shaped configuration defined by opposing legs, each having a distal section, a top surface which is at approximately the same level as the juncture of the wear bar and pipe, an interior surface adjacent to and extending between the distal section in intimate contact with said pipe through at least the lower 180° thereof, an outer surface and slot-like openings extending radially through the distal sections;

B. an interconnected reticulated wire mesh solidly embedded within said member, extending throughout said member to said legs and positioned adjacent the interior surface;

C. a connecting plate secured to each end of the wire mesh and having tabs in registry with said slots, said tabs being welded to said pipe; and D. grouting filling said slots and any space between the distal sections and the pipe.

* * * * *